United States Patent [19]

Rudoi

[11] Patent Number: 4,633,756

[45] Date of Patent: Jan. 6, 1987

[54] BULLET PROOF ARMOR SHIELD

[76] Inventor: Boris L. Rudoi, 1170 Chambers, Columbus, Ohio 43212

[21] Appl. No.: 612,310

[22] Filed: May 21, 1984

[51] Int. Cl.[4] ..... F41H 1/02; F41H 5/04

[52] U.S. Cl. ..... 89/36.02; 2/2.5; 428/911

[58] Field of Search ..... 2/2.5; 89/36.02, 36.05, 89/36.08; 109/49.5, 78, 80; 428/911

[56] References Cited

U.S. PATENT DOCUMENTS

| | | | |
|---|---|---|---|
| 796,768 | 8/1905 | Steinmetz | 89/36.02 |
| 3,563,836 | 2/1971 | Dunbar | 89/36.02 |
| 3,634,889 | 1/1972 | Rolsten | 2/2.5 |
| 3,765,299 | 10/1973 | Pagano et al. | 89/36.08 |
| 4,179,979 | 12/1979 | Cook et al. | 428/911 |
| 4,391,178 | 7/1983 | Pagano | 89/36.08 |

FOREIGN PATENT DOCUMENTS

| | | | |
|---|---|---|---|
| 663 | of 1874 | United Kingdom | 114/12 |

*Primary Examiner*—Stephen C. Bentley
*Attorney, Agent, or Firm*—Francis T. Kremblas, Jr.

[57] ABSTRACT

A bullet proof armor shield comprising a composite construction utilizing a ceramic-like armor plate and layers of a nylon-like cloth which provides a high degree of ballistic resistance and relatively light weight. The armor construction is characterized by an elongate armor component having an outer housing having a generally trapazoidal or parallelogram cross-section taken along a plane normal to its longest dimension. The armor components are adapted to be removably placed in pockets provided in an outer housing in closely adjacent relationship along the sloping edges of adjacent components to provide an overlap between them in edge to edge alignment. The individual armor components include a plurality of interior compartments adapted to receive a ceramic-like armor plate. The compartments and their respective plates are aligned in forward and rearward spaced pairs with adjacent pairs staggered to provide a degree of overlapping protection and in a pattern tending to minimize the overall weight while providing complete coverage of the area to be protected. The ceramic-like plates are of a configuration which generally adapt to the cross-section of the outer housing and include a central portion and tapered wing sections.

3 Claims, 30 Drawing Figures

FIG. 7-A

BULLET PROOF ARMOR SHIELD

BACKGROUND

Bullet proof shielding or armor has a long and varied background. As modern weapons have been developed, a commensurate effort to develop an armor construction which provides the necessary degree of protection as well as minimizes the weight of the armor has occurred.

Particularly as applied to armor which can be worn over the torso of a human, the prior art has also attempted to provide a degree of flexibility in the construction of the armor to minimize discomfort and provide reasonable manueverability.

The latest torso or vest armor which the market presently offers commercially, and which is primarily directed to military or law enforcement personnel, essentially remains a combination of steel plating and layers of tough nylon-like fabric or steel and ceramic combinations. The designs vary in relationship to the degree of protection offered which ranges from small handgun to the powerful armor piercing rifle ammunition.

One of the major problems in prior art body armor constructions capable of protecting against the more powerful ammunition is the increased overall weight of the body armor unit. One of the most popular present designs comprise steel plating in combination with many layers of a strong nylon or nylon-like fabric. This unit weighs at least approximately 18 to 19 pounds for frontal vest protection only. The cost of such units is relatively high. Other prior designs increase flexibility or lessen overall weight, however, this is accomplished only with a drammatic decrease in reliability and/or the range of the effectiveness of the protection.

Ceramic or ceramic-like materials have not generally been accepted without a composite metal backing construction since ceramic materials tend to break apart or shatter when struck by a bullet or the like. Therefore armor designs suitable for a metal or metal-ceramic composite armor plating are not particularly well suited for non-metal ceramic components. This is particularly true in applications calling for protection against high powered rifle ammunition.

Non-metallic, ceramic-like armor offers a potential solution to the problem of excessive weight even in these maximum protection applications. However, prior art efforts have failed to develop a satisfactory construction which maximizes protection and minimizes the weight factor in a practical, compact and economical manner which deals with the different characteristics of ceramic-like materials.

One of the major drawbacks to the use of the hard ceramics or glass-ceramic materials available for armor protection is the characteristic of breaking or shattering upon impact by a bullet or similar missile. Additionally, even though these materials are much lighter than steel, they must usually be employed in much thicker plates to obtain comparable effectiveness. As the thickness of the ceramic plate increases to obtain comparable stopping capability, the weight advantage of ceramic or ceramic-like materials tends to become less significant.

Another problem with ceramic or ceramic-like materials stems from this same shattering or break-up characteristic. Compared to steel, for example, the initial hit upon ceramic results in destruction of a relatively larger area. Therefore, a second hit at or very near the impact area represents a potential significant hazard to the user.

Therefore, although some ceramic or glass-ceramic materials have shown relatively good ballistic resistant properties, prior and presently available armor constructions have not offered a practical solution to permit the use of ceramic materials in armor applications having a high margin of protection and a significantly reduced overall weight to be competitive in the market.

Examples of prior art attempts to provide armor vest or body shields are found among the following U.S. Pat. Nos. 3,289,899; 3,894,472; 3,783,449; 3,855,632; 3,577,836; 2,697,054; 2,401,281 and 3,409,907. While these prior art constructions incorporate various composites of metal and non-metal, they are either too heavy, bulky, awkward or incapable of sufficient bullet stopping characteristics to provide a satisfactory solution. There has been a long unfilled need for a relatively light, compact armor design which also is capable of maximum bullet stopping capacity relative to its weight and which is well-suited to employ ceramic-like materials at their best advantage.

SUMMARY OF INVENTION

The present invention relates generally to ballistic resistance or bullet proof armor and specifically to an armor construction utilizing ceramic or ceramic-like armor plates having a novel configuration and arrangement within a suitable outer envelope or casing. The armor construction of the present invention is particularly well-suited for incorporation in a bullet proof vest although it could also be advantageously used to shield buildings, equipment or within vehicles.

The armor shield of the present invention comprises a plurality of individual or separate armor components which are adapted to be removably mounted within an outer housing.

Each armor component is provided with an outer casing having a cross-sectional configuration along a plane perpendicular to the length of the front and rear faces which generally defines either a trapazoid or parallelogram other than a rectangle. The sloping faces of each component then provide a degree of overlap with an adjacently disposed element to offer added protection at adjoining edges. The outer housing is provided with a plurality of interior parallel pockets configured similarly to the shape of each component to align them for full coverage of the area to be protected.

The outer casing of the individual armor components provided with a plurality of interior compartments disposed along the length and height of the front and rear faces of the outer casing. The compartments are formed in aligned pairs with one of each pair spaced from front to rear with respect to the other comprising the aligned pair. Further, adjacently disposed pairs are arranged in a staggered relationship to provide an overlapping relationship between portions of adjacent pairs.

A ceramic or ceramic-like plate which conforms in configuration to each compartment is disposed therein in close-fitting relationship to present a barrier or shield along the face of the armor element.

The plates are formed and arranged in a configuration which compliments the trapazoidal or parallelogram configuration of the outer casing. Preferably, the plates are also formed to take advantage of their arrangement within the compartments to minimize the overall weight of armor shield without significantly decreasing the degree of protection.

A plurality of layers of a tough, tight woven nylon-like fabric is preferably interposed within the casing between aligned pairs of plates to compliment the ballistic protection and minimize the weight. The separate compartments for each plate located within the outer casing of the armor components can be formed by sewing in a cloth-like layer or preferably may comprise a pre-formed resilient layer of molded plastic or rubber which is designed to fit within the outer casing. Means are provided in surrounding relationship to each plate tending to hold a plate in its relative position even if cracked or broken when impacted by a bullet.

OBJECTS

It is a primary object of the present invention to provide a bullet proof armor construction which offers equal or superior ballistic protection with less overall weight and in a compact form relative to comparable prior art constructions.

It is another object of the present invention to provide a bullet-proof armor construction which is easily adapted for use in a vest or torso configuration for personal body protection.

It is another object of the present invention to provide an armor construction of the type described which permits the effective use of ceramic type armor plates with improved protection against multiple hits by missiles.

It is a further object of the present invention to provide an armor construction of the type described wherein multiple components are removable mounted in an outer housing in cooperating overlapping fashion to increase the protection along a seam while tending to minimize the amount of protective plate material within the individual armor components.

It is still another object of the present invention to provide an armor construction wherein the ceramic type plates have an improved design and configuration which cooperates with their novel arrangement within the individual armor components and with the arrangement of multiple components together to increase ballistic protection while minimizing weight.

Further object and advantages of the present invention will be apparent from the following description, reference being had to the accompanying drawings wherein the preferred forms of embodiments of the invention are clearly shown.

IN THE DRAWINGS

DETAILED DESCRIPTION

Figure 1:
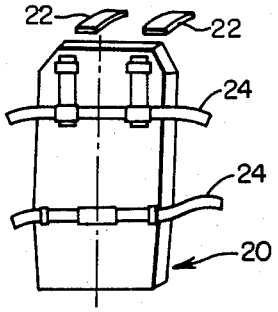
FIG. 1 is a perspective view of a bullet proof vest constructed in accordance with the present invention.
Figure 2:
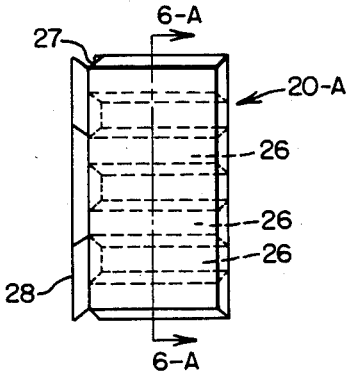
FIG. 2 is a perspective view of one of the preferred embodiments of a protective pad or outer housing constructed in accordance with the present invention which could be used in a vest configuration similar to that shown in FIG. 1.
Figure 3:
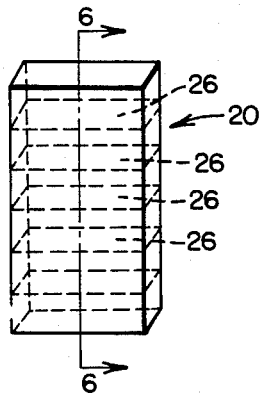
FIG. 3 is a perspective view of another preferred embodiment of the present invention illustrating a modified protective pad portion or outer housing.

A bullet-proof armor shield constructed in accordance with the present invention is illustrated in FIGS. 1, 2 and 3. For purposes of description, the armor of the present invention will be described in relationship to a vest or torso protective pad, indicated generally at 20, however, other configurations for building, equipment or vehicle protection are applicable with minor modifications without departing from the spirit of the present invention.

Pad 20 is adapted to be worn over the upper front torso and is provided with shoulder straps or pads 22 and chest and abdomen strap assemblies 24 for conventional fastening of section 20 to the torso area. If desired, a rear section for protecting the back of a user could be added by a similar attachment to straps 22 and 24.

Pad or shield 20 preferably comprises a cloth-fabric outer cover or envelope such as a sturdy canvas or nylon cloth and is provided with a plurality of interior divisions or pockets 26 which are open at one end 27. The side openings may be covered by a closure flap 28 fastened by a snap or the common velcro type fastening devices, not shown. In other applications, the outer cover could be a rigid material if desired.

Figure 5:
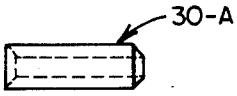
FIG. 5 is a perspective view of a modified configuration of an individual armor component adapted to be placed within the outer housing shown in FIG. 2.
Figure 4:
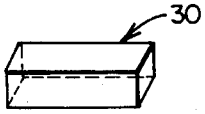
FIG. 4 is a perspective view of an individual armor component constructed in accordance with the present invention and adapted to be placed within the pad or outer housing shown in FIG. 3.

Pockets 26, for example, are formed by suitable layers of cloth sewn into a configuration adapted to receive individual armor plating components, such as indicated generally at 30 or 30-A. The component 30 has a generally parallelogram configuration, such as in FIG. 4, or a trapazoid configuration, such as in FIG. 5. The trapazoid configuration shown is adapted to be aligned in an alternating fashion between the shorter base and longer base into each corresponding pockets 26 as illustrated in FIG. 2. If the components 30 are used, pockets 26 would be similarly configured to a parallelogram shape such as illustrated in FIG. 3.

In the embodiment shown, the components 30 and pockets 26 are disposed horizontally across pad 20, however, they could also be disposed vertically if desired.

Figure 6:
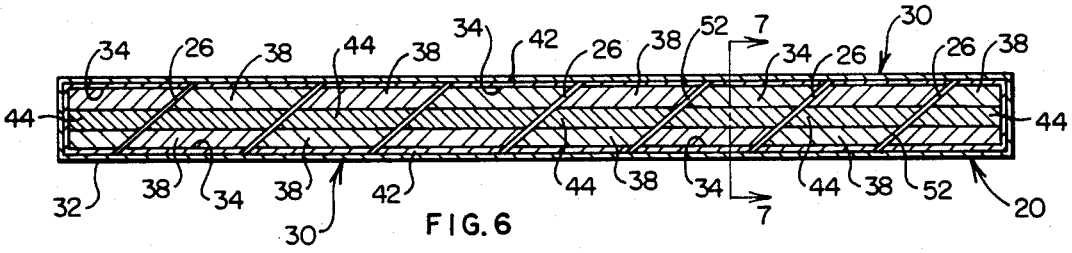
FIG. 6 is a side elevational view in section of the outer housing or pad shown in FIG. 3, the section being taken along line 6—6 in FIG. 3.
Figure 16:
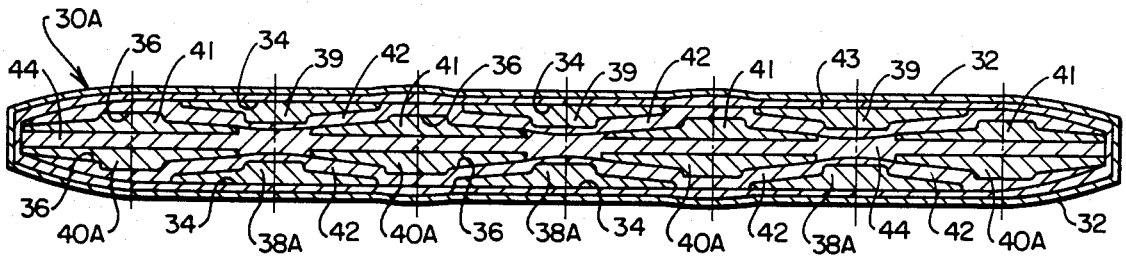
FIG. 16 is a view similar to FIG. 6 of the embodiment shown in FIG. 2, the section being taken along line 6A—6A in FIG. 2.
Figure 16:
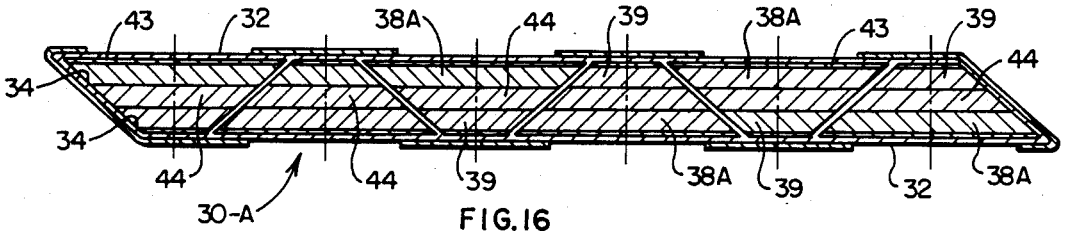
Figure 10:
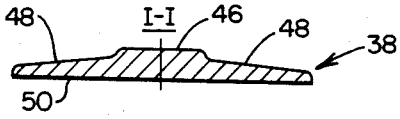
FIG. 10 is a side elevational view in section of the plate shown in FIG. 8, the section being taken along line I—I in FIG. 8.

Now referring to FIGS. 6 and 16, each armor plating component 30 or 30-A is disposed in a respective pocket 26 such that the adjacent components 30 or 30-A are aligned in partially overlapping relationship along a parallel extending sloping side thereof.

The component 30, FIG. 6, has generally parallelogram configuration in cross-section taken along line 6—6 in FIG. 3 and therefore pockets 26 are also formed to complement the shape of component 30. As viewed in FIG. 6, each component 30 overlaps the next adjacent component 30 in the respective pockets 26 which tends to increase the protection of the area of the seam between adjacent components from a bullet striking that area.

This overlapping alignment also contributes added protection by virtue of its angular disposition relative to a bullet striking pad 20 perpendicularly to the surface facing outward since the penetration ability of a moving projectile is diminished when it obliquely strikes a surface.

The most preferred angled relationship described above ranges between approximately thirty-five to forty-five degrees which is defined by the angle in either configuration 30 or 30A which is less than ninety degrees.

Figure 7:
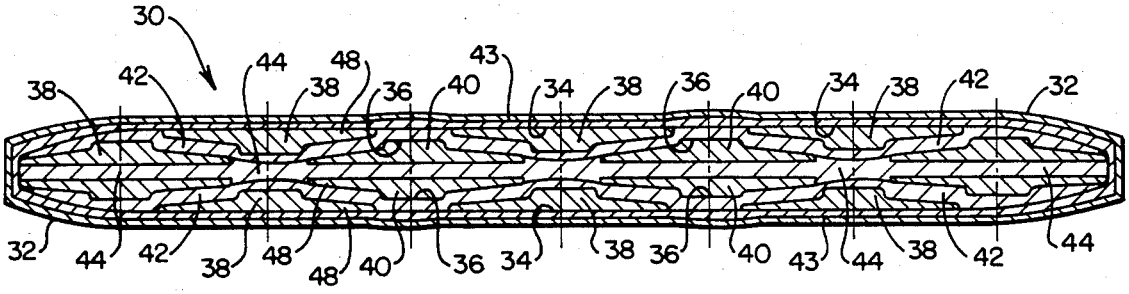
FIG. 7 is a top plan view in section illustrating an individual armor component constructed in accordance with the present invention, the section being taken along line 7—7 in FIG. 6.

With reference to FIGS. 7 and 7A, an individual component 30 or 30A is illustrated. Both embodiments appear to have essentially the same configuration as viewed in FIGS. 7 and 7A. Components 30 or 30-A are provided with an outer envelope or casing 32 which, for body vest applications, is preferably made of a sturdy cloth-like material such as canvas or nylon.

Envelope 32 is provided with a plurality of interior compartments, such as aligned pairs 34 and 36, which are adapted to receive aligned pairs of ceramic or ceramic-like plates 38 and 40 in a close-fitting relationship. Interior compartments 34 and 36 are preferably open at the top, looking downward as seen in FIG. 6, and may be closed with a flap or cover, not shown, extending across the length of component 30. This cover may be fixed to outer envelope in any conventional manner permitting it to be opened and closed as needed.

The aligned pairs of plates 38 and 40 are disposed in a respective compartments 34 or 36. The compartments may be in the form of cloth-fabric divisions or panels sewn to the interior of envelope 32, however, preferably the compartments are formed of a rubber or a plastic material having a degree of resilience or elasticity, such as a polyurethane. Then the interior compartments may be molded in sheets or layers such as 42 having the desired configuration shown by adhesively connecting the layers at appropriate end points. An outer layer of a stiffer nature, such as 43, may be advantageously used to reinforce layers 42 for ease of fabrication.

The plates 38 and 40 may be inserted into the respective compartments 34 or 36 and the entire assembly loaded into the outer envelope 32. Alternatively, the compartments as molded and pre-formed may be disposed into envelope 32 first with the plates placed in the respective compartments thereafter.

With continued reference to FIG. 7, the interior compartments are arranged in a first set of aligned pairs 34 and a second set of aligned pairs 36. The plates comprising each aligned pair 38 or 40 are disposed to substantially overlie one another relative to their width dimension parallel to the front face of component 30 as seen in FIG. 7. In the parallelogram configuration of components 30, FIG. 6, the height dimension of each plate 38 and 40 is essentially the same, however, the plates are disposed in a vertically staggered relationship conforming to the parallelogram cross-sectional shape of component 30. In the trapazoid configuration illustrated in FIG. 16, the plates of an aligned pair have the same width dimension as shown in FIG. 7A, but one of the plates of an aligned pair has a shorter height dimension as apparent in FIG. 16 and will be described in detail later herein.

As best seen in FIG. 7, the first set of aligned pairs of compartments 34 are spaced from one another in a front to rear direction to a greater degree than the second set of aligned pairs 36. Therefore the corresponding plates 38 and 40 are also similarly arranged in two sets of aligned pairs.

In the arrangement shown, the second set of 40 of the aligned pairs of plates are disposed in reversed relationship and along a plane laying in between the first set 38 of aligned pairs of plates such that outer wing portions of the plates 38, 40 are placed in an overlapping relationship relative to entry of a bullet or the like along the elongated faces of element 30.

It should be noted that the component 30 as seen in FIG. 6 is semi-flexible relative to bending between its outer ends since each plate 38 or 40 is independently supported. Also the plates 38 or 40 may be formed with only one wing section if one desires to square off the outer ends of the component. The embodiment shown in FIG. 16 illustrates end portions wherein the wing portions of the plates are the same as the interiorly disposed plates.

The preferred construction includes a plurality of layers or sheets of a cloth fabric material of a closely woven heavy gage nylon thread or other well-known nylon-like material which may be stitched or adhesively bound together to form a pad-like layer 44. A synthetic cloth-like material sold by DuPont Corporation under the brand name KEVLAR is also suitable for layer 44. This layer 44 is disposed within outer envelope 32 between each pair of aligned plates 38 and 40. Such material in combination with the ceramic-like plates complement one another to form an excellent ballistic resistant shielding effect, after a bullet has first struck one of the plates 38 or 40 and has begun to enlarge and break apart into smaller pieces.

In the embodiment shown in FIG. 6, pad layer 44 is thicker between aligned pairs 38 than pairs 40 to take up the additional space between the plates. While there is some added protection due to the increase in the number of sheets, this also tends to support and maintain the position of the plates when the user is moving about and when a plate is broken due to a hit by a bullet. However, other modifications of specific fabrications could be employed to accomplish a similar purpose without departing from the spirit of the present invention.

Now referring to FIGS. 8–13, the configuration of the plate comprising the aligned pairs 38 and 40 illustrated in FIG. 7 is shown and includes a relatively thicker central portion 46 and outwardly extending wing portions 48 tapered in thickness as they extend to the outer edge portion. The bottom surface 50 extending the full width and length of the plate 38 is essentially flat.

The plate 38 shown in FIGS. 8–13 is identical to the plates indicated as 40 in FIG. 6 which are merely disposed in a reversed position relative to the aligned pairs 38.

Figure 11:
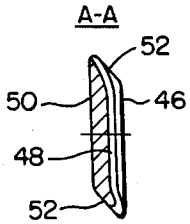
FIG. 11 is an end elevational view, in section, of the plate shown in FIG. 8, the section being taken along line A—A in FIG. 8.
Figure 8:
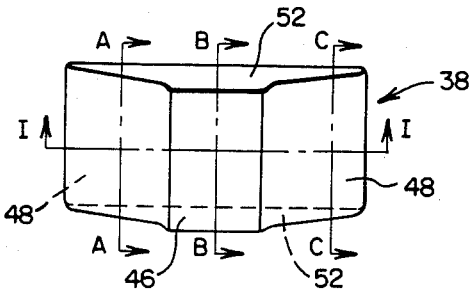
FIG. 8 is a top plan view of one of the armor plates constructed in accordance with the present invention and used in the construction of the armor component shown in FIG. 6.
Figure 12:
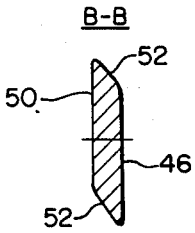
FIG. 12 is an end elevational view, in section, of the plate shown in FIG. 8, the section being taken along line B—B in FIG. 8.
Figure 9:
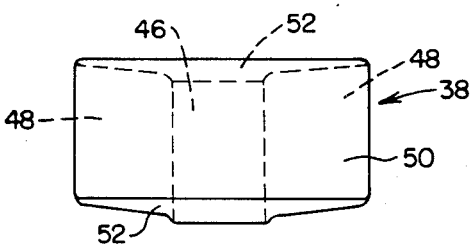
FIG. 9 is a bottom plan view of the armor plate shown in FIG. 8.
Figure 13:
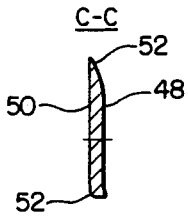
FIG. 13 is an end elevational view, in section, of the plate shown in FIG. 8, the section being taken along line C—C in FIG. 8.

As best seen in FIGS. 11–13, each plate 38 also is provided with an angled side portion 52 which preferably complements the angle of the parallelogram configuration of components 30, as seen in FIG. 6.

Now referring specifically to FIGS. 14–22, another embodiment is shown and includes plates 38-A and 40-A which illustrate the plate configuration for component 30-A having the trapazoid cross-sectional configuration seen in FIG. 16.

The same reference numerals are used for those portions of plates 38-A and 40-A which are essentially identical or functionally equivalent to the same portions of plate 38.

Plates 38-A and 40-A include the thicker central portion 46, wing portions 48, and substantially flat bottom surface 50. The primary modification of plates 38-A and 40-A involve the angled side portions 52 and 52-A which generally are reversed relative to one another to conform to the configuration of the cross-section of component 30-A shown in FIG. 16 and wherein the wing portions 48 are disposed adjacent to one another in overlapping fashion as seen in FIG. 7-A.

Figure 23:
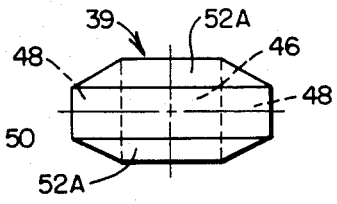
FIG. 23 is a top plan view of another modified plate construction used in the embodiment shown in FIG. 16.
Figure 27:
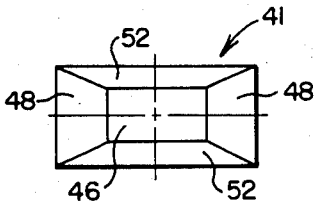
FIG. 27 is a top plan view of a modified plate construction similar to the plate shown in FIG. 23.
Figure 29:
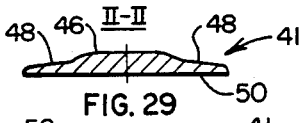
FIG. 29 is a side elevational view, in section, of the plate shown in FIG. 28, the section being taken along line II—II in FIG. 28.
Figure 28:
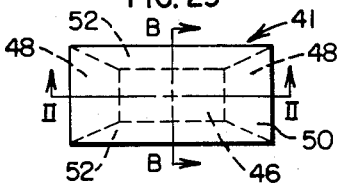
FIG. 28 is a bottom plan view of the plate shown in FIG. 27.
Figure 30:
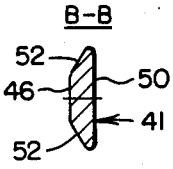
FIG. 30 is an end elevational view, in section, of the plate shown in FIG. 28, the section being taken along line B—B in FIG. 28.
Figure 17:
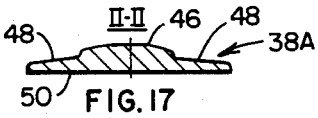
FIG. 17 is a side elevational view, in section, of the plate shown in FIG. 15, the section being taken along line II—II in FIG. 15.

The other modification in this embodiment of FIG. 16 is the use of plates 39 and 41 which are essentially of the same configuration as plates 38-A and 40-A, except for the reduced height dimension as best seen in FIG. 23 or 27. Plates 39 and 41 are disposed in forward and aft position in compartments 34 or 36 in alternating fashion with plates 38-A and 40-A to achieve the trapazoid configuration of components 30-A.

Figure 25:
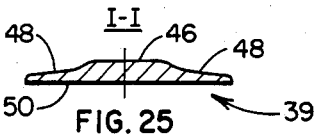
FIG. 25 is a side elevational view, in section, of the plate shown in FIG. 24, the section being taken along line I—I in FIG. 24.
Figure 24:
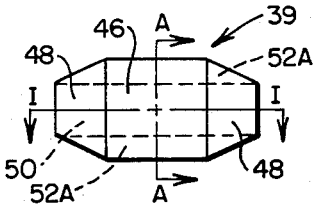
FIG. 24 is a bottom plan view of the plate shown in FIG. 23.
Figure 26:
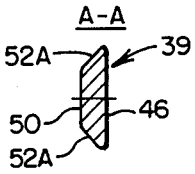
FIG. 26 is an end elevational view, in section, of the plate shown in FIG. 24, the section being taken along line A—A in FIG. 24.

It should be noted that the cross-sectional view, as seen in FIGS. 7 and 7-A, taken longitudinally through components 30 or 30-A is basically identical whether plates 38 and 40 or 38-A, 40-A and 39 and 41 are involved. This is best seen in comparing FIGS. 17 and 25 with FIG. 10.

Figure 14:
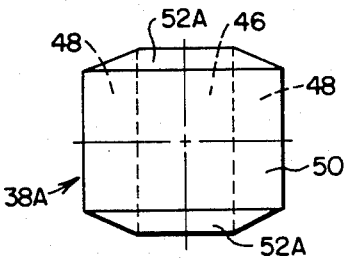
FIG. 14 is a bottom plan view of a modified armor plate construction used in the embodiment shown in FIG. 16.
Figure 15:
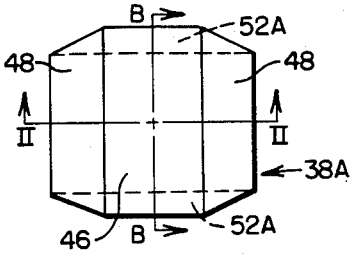
FIG. 15 is a top plan view of the plate shown in FIG. 14.
Figure 18:
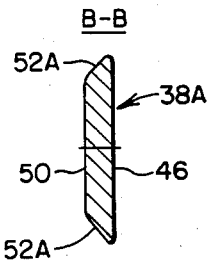
FIG. 18 is an end elevational view, in section of the plate shown in FIG. 15, the section being taken along line B—B in FIG. 15.
Figure 21:
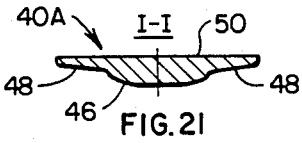
FIG. 21 is a side elevational view, in section, of the plate shown in FIG. 20, the section being taken along line I—I in FIG. 20.
Figure 19:
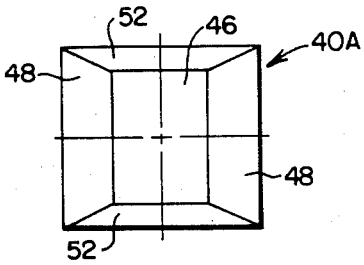
FIG. 19 is a bottom plan view of a modified plate construction used in the embodiment shown in FIG. 16.
Figure 20:
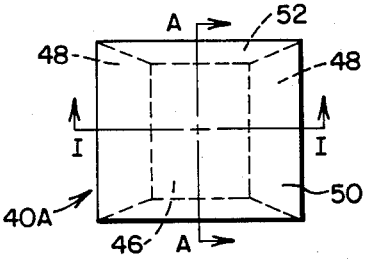
FIG. 20 is a top plan view of the plate shown in FIG. 19.
Figure 22:
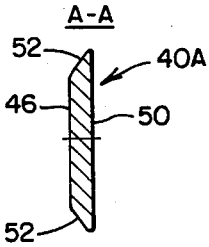
FIG. 22 is an end elevational view, in section of the plate shown in FIG. 20, the section being taken along line A—A in FIG. 20.

The primary difference between plates 38-A and 40-A is apparent with a comparison of FIGS. 14 and 19. Plate 38-A, in effect, has the angled side portion 52-A reversed in relationship to side 52 of plate 40-A. This configuration enables the wing portions 48 to overlap in edge to edge fashion with the adjacent plate disposed in opposite relationship as best seen in FIG. 7-A. This alignment is possible because of the trapazoidal cross-sectional shape and the unique arrangement of the plates in component 30-A. Since the corner portions of plates 38-A are, in effect removed, and are somewhat redundant for essential coverage and protection, this modification provides for a reduction of the weight of plates 38-A relative to merely duplicating plate 40-A. A similar relationship exists for plates 39 and 41 as seen in comparing FIG. 23 with FIG. 27.

The preferred material for the plates, such as 38 and 40, is one of the glass-ceramics which exhibit desirable properties of hardness and mechanical strength and yet possesses a much lower density than steel and are less expensive to manufacture.

For example, certain glass ceramic compositions of the lithium, aluminum and silicate oxide type have been demonstrated to possess good to excellent ballistic resistance properties and possess a density significantly less than 2.8 grams per cc. However, other ceramic or ceramic-like materials may be used in appropriate applications without departing from the spirit of the present invention.

Referring to FIG. 7, the unique arrangement of the aligned pairs of plates 38 and 40 in cooperation with the configuration of the plates offer thorough coverage of the protected area while tending to minimize the overall weight of the armor component 30 in a compact and efficient manner. For example, the thicker central portions 46 of plates 38, 40 or 38-A and 39 are aligned with one another to provide a shield comprising at least two plates. However, since the wing portions 48 are disposed in a staggered overlapping relationship and represent a barrier consisting of four separate plate surfaces, the wings may be significantly less thick compared to the central portions. Further, this arrangement very efficiently aligns the plates in pairs taking into account sufficient and complete coverage of the area to be protected.

While glass-ceramic materials such as suggested herein exhibit excellent hardness and impact mechanical strength, they do tend to shatter at the point of impact and form cracks which may extend to the outward edges of the plate. The extent of the opening or hole created and the degree of cracking or break-up of the plate is a function of the given properties of the specific glass-ceramic material given the same size and velocity of the projectile.

However, in order to avoid penetration of fragments of the bullet and the ceramic plate through the vest shield, it is very desirable to have at least two separate plates aligned with one another rather than one plate of equal or greater thickness than the two plates.

Merely stacking multiple plates behind one another or increasing their thickness tends to undesirably increase the weight of the armor to a point wherein the ceramic would not compete on a practical basis with prior steel armor designs.

A further improvement in missile stopping capability is obtained by maintaining a degree of separation between the ceramic plates which can be enhanced by placing a material, which alone is not a particularly efficient barrier, between the plates. This material preferably may consist of layers or sheets of the heavy gauge nylon or nylon-like coth. For example, even as few as four to seven sheets of such material is very effective to enhance protection when placed between plates 38 and 40 without a significant increase in weight.

This improved resistance or stopping capability of such material is related to the effect of the ceramic material on the bullet. A bullet striking the plate 38 tends to mushroom in size due to the nature of the hardness and mechanical strength of the glass-ceramic material and further begins to deform and fragment. The natural reduction of momentum that occurs upon striking the plate, and the fragmentation of the bullet into smaller pieces, permits a relatively few layers of the cloth to become more effective in absorbing some of the momentum of the smaller fragements which include small pieces of the ceramic plate itself. The distance between each pair of aligned plates also provides for an area of less resistance to expansion of the bullet. The greater this expansion, the wider the subsequent area of impact upon the second plate of an aligned pair.

Assuming the bullet impacting the armor component is near the upper design limit in terms of size and/or velocity, the second plate 38 or 40 now receives primarily a plurality of smaller bullet fragments and pieces of ceramic material from the first plate. These pieces are now at a reduced velocity and are spread over a greater area than the initial bullet configuration striking the first plate.

One of the features of certain glass-ceramics is surface hardness. Therefore, the bullet fragments striking the separate, second plate, must also overcome the surface hardness of a new plate in addition to the inherent mechanical strength and impact resistance of the ceramic material. Since the fragements are smaller and their velocity is significantly reduced, and the area over which the impact is received is effectively increased, the second plate offers an effective barrier to stopping dangerous penetration and injury even at a surprisingly modest thickness.

These aspects permit the thickness of the ceramic plates to be reduced compared to a single plate of double thickness thereby reducing the overall weight of the armor shielding component relative to the desired stopping capability.

The preferred design disclosed herein also provides a significant area wherein a barrier or shield is formed by four separate portions of aligned pairs 38 and 40 where the wings 48 overlap one another. The staggering of the aligned pairs as disclosed herein combined with the reduced thickness of the wing portions 48 provides more efficient protection and a compact construction while minimizing the weight required as compared to prior art designs.

The preferred ratio between the length of the wing portions 48 to the thicker central portion depending upon whether the trapazoid or parallelogram configuration is used ranges from approximately two-thirds to two times the length of the thicker central portion.

Since four separate plate surfaces are involved in areas defined by the overlapping wing portions, an excellent ratio between stopping power and weight is achieved while maintaining the minimum two plate barrier or shield having sufficient thickness to resist penetration in the area where the central portions 46 are aligned.

It is believed that the parallelogram configuration represents the preferred form and offers the most efficient ratio between stopping capability versus weight for any given thickness of the plates and maintains the design, manufacture and fabrication of the components within very practical economic ranges for mass production at reasonable cost.

It should also be noted that the construction of the present invention wherein the plates 38, 40 are disposed in close-fitting relationship within the interior compartments tends to maintain the plates in position even after a plate has been struck by a bullet and partially or wholly cracked into two or more pieces. Therefore, while the immediate area of impact of the bullet is destroyed, the surrounding undestroyed plate portions remaining offer relatively equal protection from a second bullet striking those portions as the original plate. Only the relatively small area damaged by the first impact would be considered dangerous and the chances of a direct hit in the same area prior to having an opportunity for replacement or repair is very, very small.

If desired, the plates 38 and 40 may be covered with an adhesive cloth fabric tape or equivalent material to futher aid in maintaining the relative positioning of a plate in compartments 26 upon cracking after impact. Once a vest has suffered a strike by a bullet or bullets, as soon as possible thereafter, components 30 may be replaced as needed in a very simple manner. A new component 30 may be inserted through the open end 27 and into the appropriate pocket 26 after removal of the damaged component. Depending upon the extent of the damage, the original component 30 may be re-conditioned for re-use by replacing the damaged plates. Conventional spot repair materials may be used to patch the outer envelope and portions of layers 42 or 43.

For purposes of example only, testing was conducted with ceramic plates of the type indicated herein, having a thickness of nominally 6.5 millimeters. Two of these plates were placed in back to back engagement with only two layers of a heavy cloth material commercially sold under the brand name KEVLAR between the plates. A cloth-like tape was used to secure the plates and cloth together. This combination very satisfactorily stopped any injurious penetration of fragments of a 30.06 rifle bullet fired from a perpendicular angle approximately three to four feet from the plates.

Therefore in view of the foregoing description, it should be readily apparent that an armor shielding component is disclosed which can be constructed to have equal stopping capability and a reduced weight per unit of area compared to high quality prior armor constructions presently commercially available.

For example, one of the higher quality bullet proof vests capable of stopping a high powered modern rifle bullet weighs approximately eighteen to nineteen pounds. An equivalently effective bullet proof vest garment constructed in accordance with the present invention weighs at least approximately twenty-five percent to forty percent less representing a reduction of the overall weight between four and one-half to approximately seven pounds.

In addition, the glass-ceramic materials which may be employed are generally less costly than steel which is the primary material of prior armor shields or vests capable of stopping penetration of the modern high power rifle ammunition.

A possible modification still employing the principles of the present invention would be the substitution of other non-metallic materials for ceramic, such as for example, a laminated glass which possesses resistance to impact by projectiles and is not so heavy as to be impractical for the application.

What is claimed is:

1. In an armor shield having a front and rear face, the combination of: a plurality of elongated rows, each of said rows formed by a plurality of ceramic plates arranged in adjacent relationship to one another to form a projectile barrier; each of said plates forming one of said rows having a first surface and a second generally planar surface, each extending in a generally parallel direction to the front and rear faces of said armor shield; said first surface including a generally rectangular central portion and a pair of intergrally formed wing portions having a generally quadrilateral configuration, said central portion being upraised from said wing portions; each of said plates forming one said elongated rows being disposed in said row with its first surface oppositely disposed relative to the disposition of said first surface of adjacent plates in said row and with its wing portions essentially fully overlapping a wing portion of each adjacent and oppositely disposed plate in the row; and each plate further having a cross-sectional configuration along a plane perpendicular to the length of said rows which defines a quadrilateral configuration taken from a group consisting essentially of a parallelogram or a trapezoid; each of said elongated rows of plates being disposed closely adjacent to one another with the sides of said plates defining the major and minor angle of said quadrilateral configuration being in overlapping relationship with the sides of the plates in an adjacently disposed row of plates.

2. The shield defined in claim 1 including a second projectile barrier formed by another plurality of said elongated rows of said plates disposed in rearwardly spaced parallel relationship to said first defined elongated rows, each of said plates in said second projectile barrier aligned in parallel relationship with a respective one of said plates in said first defined projectile barrier and having its first surface disposed in an oppositely facing direction relative to said first surface of an opposing plate in said first defined projectile barrier.

3. The shield defined in claim 2 wherein the plate forming a parallel set of said first and second projectile barriers are disposed with the sides of each of said plates defining the major and minor angles of said quadrilateral configuration being aligned parallel to one another.

* * * * *